United States Patent [19]

Sadamatsu et al.

[11] 3,959,153

[45] May 25, 1976

[54] MANUFACTURING METHOD FOR ELECTROPHOTOGRAPHIC DEVELOPING AGENT

[75] Inventors: Shigeru Sadamatsu; Hiroyuki Kaneko; Keitaro Ohe; Daijiro Nishio, all of Odawara, Japan

[73] Assignee: Fuji Photo Film Co., Ltd., Minami-ashigara, Japan

[22] Filed: May 28, 1970

[21] Appl. No.: 41,647

[30] Foreign Application Priority Data

May 28, 1969 Japan ..... 44-41468

[52] U.S. Cl. ..... 252/62.1 P; 96/1 LY; 96/1 SD

[51] Int. Cl.[2] ..... G03G 9/00

[58] Field of Search ..... 96/1 LY, 1 SD; 252/62.1; 117/17.5, 37 LE; 260/29.6 NR, 17 A

[56] References Cited

UNITED STATES PATENTS

| | | | |
|---|---|---|---|
| 2,788,288 | 4/1957 | Rheinfrank et al. | 117/17.5 |
| 3,011,918 | 12/1961 | Silvernail et al. | 117/201 |
| 3,190,847 | 6/1965 | Mitchell et al. | 260/29.6 NR |
| 3,335,100 | 8/1967 | Geyer | 117/201 X |
| 3,338,991 | 8/1967 | Iusalaco et al. | 252/62.1 X |
| 3,391,082 | 7/1968 | Maclay | 252/62.1 |
| 3,554,778 | 1/1971 | Granzow | 252/62.1 X |
| 3,585,140 | 6/1971 | Machida et al. | 252/62.1 |
| 3,586,654 | 6/1971 | Lerman et al. | 252/62.1 X |
| 3,634,251 | 1/1972 | Maeda et al. | 252/62.1 |
| 3,706,722 | 12/1972 | Nelson et al. | 260/17 A |

OTHER PUBLICATIONS

F. A. Bovey et al., Emulsion Polymerization, Interscience Publishers, Inc., (1955), pp. 12–14.

R. W. Lenz, Organic Chemistry of Synthetic High Polymers, John Wiley & Sons, Inc., (1967), pp. 361, 362.

C. E. Schildknecht, Vinyl & Related Polymers, John Wiley & Sons, Inc., (1952) pp. 211–214, 332, 393–395.

*Primary Examiner*—William A. Powell
*Assistant Examiner*—Brian J. Leitten
*Attorney, Agent, or Firm*—Gerald J. Ferguson, Jr.; Joseph J. Baker

[57] ABSTRACT

This invention is a method for manufacturing an electrophotographic developer for use in electrophotography or electrostatic recording processes. The developer comprises polymer particles by suspension polymerizing, in an aqueous phase, a polymerization liquid comprising at least one polymerizable vinyltype monomer, a polymerization initiator, and a finely divided dispersion stabilizer either sparingly soluble or insoluble in water and said monomer. Said polymerization liquid is blended prior to suspension polymerization. The improvement includes adding to said liquid, a resinous substance, as a fluidizer which is soluble in the monomer and having a solubility parameter in the range of from 7.8 to 16.1. During the blending, the dispersion stabilizer is uniformly dispersed throughout said polymerization liquid. Next, the blended polymerization liquid containing the fluidizer is suspended in the aqueous phase and then such blend is subjected to said suspension polymerization to effect polymer particles having diameters in the range of 0.1 to 100$\mu$.

9 Claims, No Drawings

MANUFACTURING METHOD FOR ELECTROPHOTOGRAPHIC DEVELOPING AGENT

This invention relates to a method of the manufacture of a developing material to be used for electrophotography or electrostatic recording processes.

In electrophotography, a photoconductive layer is charged electrically and thereafter exposed to the light of an image derived from an original pattern to form an electrostatic latent image. Thereafter, the latent image is converted into a visible image by applying to the layer a developing agent or a toner. Broadly, the developing system is classified into a dry type and a wet type. In either type, the developer contains, as the main ingredients, a coloring material for visualizing the latent image and a carrier for fixing the visualized image on the layer. Generally, a dry type developer is made of a finely divided powder called "toner". A typical dry type developer is a mixture consisting of such coloring material as dye and pigment and a carrier such as thermoplastic fusible or soluble resin. Wet-type developer is generally called liquid developer. A typical wet-type developer is one which is prepared by dissolving a carrier a resin and dispersing in the resultant liquid carrier coloring material such as a dye and pigment.

The present invention provides a novel method for the manufacture of the aforementioned dry and wet-type developers, particularly dry-type developers, for electrophotographic use. For the preparation of dry-type developer or toner, there has heretofore been employed a method in which carbon black or similar pigment is mixed in a molten thermoplastic resin to form a uniform dispersion and, thereafter, the dispersion is divided into a finely reduced powder by means of a suitable kind of pulverizing equipment.

The toner obtained by this method can acquire a number of excellent properties but, at the same time, assumes many drawbacks. For example, it is subject to restriction from the standpoint of material. Since this method involves the steps of fusion and pulverization, the materials are required to be fluidized at a suitable temperature and to permit the pigment and the like to be mixed uniformly, and the mixture must be processed at a high rate to a desired particle size within the pulverizing equipment being employed. If there are used readily disintegratable materials, they are much more integratable within the electrophotographic equipment so as to cause smearing of equipment, fogging of image, and other shortcomings. In the use of simply fusible materials, there is a possibility that the toner will be conglomerated and deposited in the form of film on the photoconductive plate.

In addition, it is not unlikely that, while the pulverization is in progress, the pigment buried within the resin will appear on the surface to give rise to a non-uniform distribution of frictional electric property, though to a minor extent. Further, it is conceivable that the moistureproofness will pose as a serious problem, depending on the kind of pigment used.

A still more serious drawback is believed to consist in the distribution of shape and size of toner. The toner which is prepared by pulverization has an amorphous shape so that there tends to occur entanglement (aggregation) of toner particles. This is expected to function as an undesirable factor with respect to the stability of toner during storage, dispensability of toner at the time of supply, clearness of image at the time of image development, and cleaning propensity of the sensitive plate during repeated use, and so on. The most serious shortcoming is believed to consist in the extreme difficulty that is involved in the stage of pulverization when an attempt is made to pulverize the materials to desired particle sizes falling within the range of uniform particle distribution. The toner to be used as the dry-type electrophotographic developer generally has an average particle diameter of 10 microns. In the case of the pulverization process, when there are selected materials capable of being pulverized at an economic speed, there are produced extremely fine particles with diameters less than a micron. Even so, coarse particles with diameters of several tens of microns or greater diameters remain unpulverized and mingle into the product. The extremely fine particles and highly coarse particles thus remaining in a very small proportion have a conspicuous effect upon the generally acquired image quality, particularly, resolvability, clearness, and fogging. Consequently, the image quality is heavily degraded.

Besides the pulverization process mentioned above, there have been proposed methods for the manufacture of dry toner based on the process of polymerization, as disclosed in Japanese Patent Publication No. SHO 36-10231 by Iwatsu Electric Company and Japanese Patent Publication No. SHO 43-10799 by Koppers Inc. The former disclosure is based on the so-called suspension polymerization: This method is composed of two steps. In the one step, a mixture of synthetic resin monomer, polymerization initiator, dispersion stabilizer, and coloring material is suspension-polymerized to give rise to a toner, and in the other step, the resultant polymer is treated with a surface-active agent during or after the step of polymerization so as to acquire electrostatic charge. The latter disclosure is based on the so-called emulsion polymerization: According to this method, an aqueous emulsion of synthetic resin monomer containing emulsifier (surface-active agent) and polymerization initiator is catalytically polymerized, the resultant latex is combined with a coloring material, and the emulsified dispersion is spray dried to produce toner particles. The factors which are common to these toners are the fact that both toners are spherical in shape and embrace pigment within and the fact that the surface-active agent is used in the process of manufacture. For very fine and stable emulsification of the monomer within water, the emulsion polymerization process uses the surface-active agent, which is termed as an "emulsifier". In the suspension polymerization process, there is used the dispersion of the monomer in water and the polymer must not be conglomerated. Broadly, there are two methods available. The one method dissolves a water-soluble high molecular weight substance in water. This method requires a relatively small amount of such substance and involves a simple procedure. However, such method as this cannot obtain a finely pulverized polymer with uniform particle distribution and suffers from the defect that the water-soluble high molecular weight substance will be absorbed on the surface of polymer particles or grafted thereto so as to cause smearing. The other method uses a sparingly soluble inorganic salt powder in a suspended state. Although there can be obtained a polymer of fairly uniform particle distribution by improving the dispersibility of the sparingly soluble inorganic salt powder itself, the dispersion is insufficient and unstable when the powder is used independently. Thus, there is used the surface-active agent in combination with a view to improving and stabilizing the dispersion of that powder.

However, the use of such a surface-active agent is not necessarily desirable from the electrophotographic point of view. When the surface-active agent is used at all, perfect removal thereof is extremely difficult because of the property of surface activity. Even if labor and time are consumed to a fair extent for cleaning, it remains to some extent on the surface of polymer particles. In the meantime, the electric properties of the toner which is used for a dry electrophotographic process or an electrostatic recording process rely substantially upon the surface property. Therefore, if such water-soluble high molecular weight substance and surface-active agent remain on the surface, though to a slight extent, there develop various problems. For example, the electroconductivity and the moisture-reliance of the surface active agent itself may affect the electric properties of the toner directly so as to substantially injure the frictional electric property of toner. Further, if the surface active agent remains on the surface of toner particles, it tends to absorb various smearing materials. Besides, the surface active agent transfers itself from the tone particles onto the carrier or the sensitive plate surface during its repeated use, and the deposited surface active agent degrades the carrier or the plate and cuts their service life. Thus, their electrophotographic properties are deprived of stability remarkably. These drawbacks also appear when the toner thus prepared is used as th so-called wet developing agent. They are expected to emerge in the form of degraded insularity of the carrier liquid, acquisition of electroconductivity by the toner particles themselves, and declined stability of surface charge due to the absorption of various extraneous matters. Nonetheless, the defects ascribable to the use of surface active agent appear more conspicuously in dry developing agents.

The present invention proposes a novel method for the manufacture of electrophotographic toner which overcomes various shortcomings mentioned above for toners prepared by the pulverization process and the polymerization process. To be specific, this method comprises the step of preparing an oil-phase component made up of one or more kinds of synthetic resin monomers, coloring materials (dye and/or pigment in finely divided state), a polymerization initiator, and a finely pulverized dispersion stabilizer (such as metal powder or inorganic salt oxide), adding to the oil-phase system a relatively polar resinous additive (to be referred to as "fluidizer" hereinafter) soluble in the monomers being used in the preparation of the oil-phase component thereby improving and uniformly stabilizing the dispersion of the finely divided dispersion stabilizer within the oil-phase, thereafter suspension polymerizing the oil-phase component in an aqueous phase, and if required subsequent to polymerization, removing the finely divided dispersion stabilizer through dissolution with an acid, for example, and removing the polymer particles from the aqueous phase and drying them to produce the toner. Where the toner is to be used as the wet developing agent, the toner thus obtained is dispersed in a carrier liquid. Otherwise, it is permissible to use a finely divided dispersion stabilizer which has undergone the surface treatment involving the use of such fluidizing agent as the surface improving agent. Since this fluidizing agent is not a surface active agent, it does not give rise to the various defects which are involved in the use of surface active agent as already mentioned. Moreover, the fluidizing agent contributes to the improvement and stabilization of dispersion of the pigment as well as the finely divided dispersion stabilizer in the oil-phase. Thus, even a small amount of fluidizing agent enables the user to obtain an image of high color density and consequently serves to reduce the consumption of these two substances. In addition, it has an excellent characteristic that, if the material is selected suitably, it can control the sign of electric charge of the toner as well as the amount of toner. A more detailed description of this point follows.

For the stabilization of suspension of the oil phase in the aqueous phase in the suspension polymerization process, there are two conceivable methods as already described. The one method uses a water-soluble high molecular weight substance, and the other method uses a finely divided dispersion stabilizer. According to the former method, there cannot be obtained a suspension having finely divided and uniform particles of the grade usable for electrophotographic toner. As regards the latter method, an ordinarily practiced method uses a relatively hydrophilic, sparingly soluble finely divided dispersion stabilizer suspended in water. In this form, the dispersion within the dispersion stabilizer is insufficient and unstable and the stabilizing activity against oil drops is also insufficient. Therefore, there is also obtained coarse particles. Thus, here is used a surface active agent to help uniformize the dispersion of the finely divided dispersion stabilizer itself in water. Even by doing so, it is difficult to obtain particles having very fine particle sizes in a narrow range suitable for the electrophotographic toner. By contrast, the method which uses a sparingly soluble finely divided dispersion stabilizer in the state forcibly suspended in the oil phase can produce polymer particles having very fine and uniformly distributed particle sizes. In this case, finely divided dispersion stabilizer transfers itself, in the course of polymerization, from within oil drops to the intersurface of oil drop/water phase so as to coat and protect the oil drops. In this state, the stabilizer promotes the unification of oil drops due to collision between oil drops and stabilization of dispersion. Different factors are conceivable which affect the size of polymer particles and the distribution of polymer particles. Of the many factors, most important are the degree of agitation, particle size of finely divided dispersion stabilizer itself, ratio of addition to the monomer, and the degree of dispersion within the monomers. Where there is used a device having a fixed agitation capacity, the results to be obtained are improved in proportion as the finely divided dispersion stabilizer is decreased in particle size, the ratio of addition is increased, and the state of dispersion is improved. However, when the amount of dispersion stabilizer to be added to the monomers is increased with a view to obtaining a finer particle size, the oil-phase of the solution will acquire an extremely thixotropic state so that it will result in highly difficult handling in the course of production. If a ball mill is employed as a means of mixing, for example, it is difficult to remove. Further, since no sufficient mixing can be achieved within the mill, the degree of dispersion is degraded so as to give rise to rather coarser particles. If it is possible to improve the state of dispersion of the finely divided dispersion stabilizer itself within the monomers without changing the ratio of addition, those problems mentioned above will not occur. Then, this practice will prove far more economical, because use of a smaller quantity permits polymer particles to be reduced fine particles having a more uniform particle distribution. In this respect, it is conceivable to improve the dispersion stability in the monomers of the finely divided dispersion stabilizer through the use of a surface active agent soluble in such monomers. However, the use of surface active agent has various adverse effects upon the surface property of the toner to be produced as already described. Moreover, since it is used within the monomers, it will obstruct the transfer of the finely divided dispersion stabilizer present in the monomers to the interface of oil drops and aqueous phase during the process of polymerization. From these standpoints, this is not desirable.

The present invention provides a novel method for the manufacture of electrophotographic toner, which method promotes the dispersion and stabilization of the finely divided dispersion stabilizer within the oil phase without having to use a surface active agent which exerts adverse effects upon the process of polymerization and the product properties as already mentioned so as to obtain a product with fine and uniformly distributed particle sizes. The fluidizers to be used for this purpose are comparatively polar, resinous substances (such as resin, polymer, prepolymer, and oligomer) having solubility parameter values (hereinafter referred to as "SP", suggested in "Polymer Handbook" IV - 341 through 368, John Wiley & Sons, 1966 ed.) in the range of 7.8 to 16.1, and they are soluble in the oil-phase component to be used. Generally, the ratio of addition is very low. Occasionally, desired effect can be derived at a very low ratio of 0.001% as based on the monomers. The actual amount to be required and the type of fluidizer to be employed are determined according to the components and composition of the oil phase, including monomers, additives, and finely divided dispersion stabilizer. The fluidizer remains in the toner as the product. For practical purpose, it manifests its effect sufficiently in the addition ratio less than about 1%. Since it is dissolved uniformly within the toner, it does not have an adverse effect on the physical and electrical surface properties of the toner as does the surface active agent. This is a marked characteristic of the fluidizer. Some types of pigments such as carbon and cyanin pigments should be used in as small quantities as possible, because they tend to retard, control, or obstruct the polymerization. The fluidizer serves to improve the dispersibility of these pigments in the oil phase and heighten the color density of the toner image substantially, and, consequently, makes it possible to reduce their consumption. One of many other characteristics is the fact that the fluidizer, if used in an increased quantity, can control the charging property (as to sign of charge, amount and distribution of charge) and the thermal property of the toner.

The fluidizer is selected from among natural and synthetic resinous substances having solubility parameter values (SP) in the range of from 7.8 to 16.1. The SP is the value which is the square root of the cohesion energy density (abbreviated as CED), which serves as the yardstick of the intermolecular force. The magnitude of SP is related to the polarity of the substance under review. Physically, CED is the quantity of energy which is required for evaporating 1 cc of liquid (solvent). The SP value of the resinous substance to be used as the fluidizer can be determined by the method which uses various physical quantities for calculation or by another method which involves an experimental procedure. Since the former method is effective only for substances having known composition and structure, the determination is made mostly by the latter method. There are various versions of the experimental method, including that which uses solubility and that which employs the degree of swelling as the basis of calculation. With respect to ordinarily available resinous materials, the most effective procedure is to dissolve the resinous substance intended to be used as the fluidizer in many solvents having different SP values, determine the ultimate viscosities, and take the SP value of the solvent which gives the maximum ultimate viscosity as that of the fluidizer under discussion.

| Name of Solvent | (Polymer Handbook IV) SP |
|---|---|
| 1. Diisopropyl ether | 6.9 |
| 2. n-Hexane | 7.3 |
| 3. Diisobutylketone | 7.8 |
| 4. Cyclohexane | 8.2 |
| 5. n-butyl acetate | 8.5 |
| 6. Xylol | 8.8 |
| 7. Methylethyl ketone | 9.3 |
| 8. Methylene chloride | 9.7 |
| 9. Acetone | 9.9 |
| 10. Ethyleneglycol monoethylether | 10.5 |
| 11. Pyridine | 10.7 |
| 12. Nitroethane | 11.1 |
| 13. n-butanol | 11.4 |
| 14. Acetonitryle | 11.9 |
| 15. N,N-dimethylformamide | 12.1 |
| 16. Ethanol | 12.7 |
| 17. Nitromethane | 12.7 |
| 18. Propiolactone | 13.3 |
| 19. Methanol | 14.5 |
| 20. Methylformamide | 16.1 |
| 21. Formamide | 19.2 |
| 22. Water | 23.4 |

The magnitude of SP value is proportional to the polarity of the substance in question. As the fluidizer for the present invention, there are used relatively polar, resinous substances having SP values in the range of from 7.8 to 16.1.

An ordinary process employed for the manufacture of the electrophotographic toner of this invention is as follows. To allow such coloring material as carbon black or cyanin blue to be dispersed uniformly in a synthetic resin monomer as methacrylic methyl ester or styrene, the two components are fixed by using a ball mill, for example. At this time, a sparingly soluble finely divided dispersion stabilizer as calcium phosphate or zinc white is added at the same time. Further for the purpose of uniformizing the dispersion, a required amount of fluidizer such as ethyl cellulose or polyurethane is incorporated into the mixture. Thus, the entire mixture is blended and dispersed for several hours. At any desired stages in the process, there may be added plasticizer modifying polymer, prepolymer, or oligomer, a chain transfer agent, and other additives, as well as polymerization initiator. Then, the oil-phase component removed from within the ball mill is suspended in water and retained in the suspended state with continuous agitation and allowed to undergo polymerization continuously, if necessary, under application of heat. In the process of this polymerization, the finely divided dispersion stabilizer which is uniformly dispersed in the oil phase is transferred to the oil phase-/aqueous phase interface so as to stabilize the suspended state and divide the oil phase uniformly and finely in the aqueous phase at the same time. Upon completion of the polymerization, there is added hydrochloric acid, for example, so as to dissolve and remove calcium phosphate and zinc white used as the dispersion stabilizer and arranged on the interface. Thereafter, the system is filtered by means of a centrifugal separator, washed with water, dehydrated, and then dried by means of a suitable drying means to give rise to a toner.

Now, the many outstanding characteristics of the electrophotographic toner which is obtained by the manufacturing method of this invention are described below.

1. Because the toner particles are globular, the toner improves such image qualities as resolvability, clearness, and fogging and enhances the cleaning property. The dispensing property and storability are also improved.

2. Extremely fine toner can be manufactured with very high degree of control. Toner particles of the order of submicrons to microns, further to several tens of microns to several hundreds of microns, which have hitherto been considered to be the intermediate between those obtained by the suspension polymerization and those by the emulsion polymerization, can be manufactured freely by controlling the addition ratio of the sparingly soluble finely divided dispersion stabilizer to the monomers.

3. There is obtained extremely high uniformity of particle distribution, which excels the uniformity of particle distribution by any manufacturing method employed in the past. Extremely fine particles having the diameter of submicrons and coarse particles having the diameter of several tens of microns, which cause image quality deterioration in the dry electrophotography, can be removed substantially completely.

4. The toner particles are highly uniform on the surface and inside. They are stable, because their surface is free from extraneous matters that can cause electrical deterioration. This means that the toner will not degrade the carrier or the sensitive plate so that the consumable materials can be given a greatly elongated service life. Such a property as this cannot be obtained by the toner which is prepared by the method of similar polymerization using a surface active agent.

5. The solubility characteristic, fusibility characteristic, and other similar fixing and storage stability characteristics of the toner can be controlled in a wide range by controlling the selection and combination of monomers and the polymerization conditions.

6. Where pigments are used in the oil phase, the fluidizer to be used for the dispersion of finely divided dispersion stabilizer also contributes to the promotion of the dispersion of these pigments. Therefore, the fluidizer if used in a very small quantity, can produce an image of very high color density. Since the dispersion of pigments is uniformized, the charging property of the toner is stabilized to a great extent.

7. Compared with the process by which the polymerized polymer is subjected further to the steps of blending and pulverization, in the present process the toner is manufactured while the polymer is formed directly from monomers. Therefore, the process itself enjoys high economy.

8. The ratio of the oil phase to the aqueous phase can be raised to a fairly high level without sacrificing the stability. Thus, the method of this invention offers a high yield. Since the process involved is quite simple, a series of production devices can be used for manufacturing many kinds of toner one after another simply by changing formulations. Also from the viewpoint of production and operation, this can be called an excellent manufacturing method.

A brief description is made with respect to the materials which can be used for the manufacturing method of the present invention. The principal materials to be used for this invention are synthetic resin monomers, coloring materials, finely divided dispersion stabilizer, and fluidizers. In the synthetic resin monomers, there are included all the monomers that are polymerizable. Typical monomers are vinyl type monomers possessed of the group of $>C=C<$, such as styrene, acrylic alkyl, methacrylic alky, vinyl chloride, and vinyl acetate. Also usable are polyester monomers, which may be used independently or in combination with other components. As the coloring materials, all organic and inorganic dyes and pigments can be used. Typical coloring materials include carbon black, cyanin type pigments, quinacridone type pigments, and oil-soluble dyes. Dispersible dyes may be transferred from the aqueous phase into the oil phase, or the coloration may be effected with water-soluble dyes. As the finely divided dispersion stabilizers, there may be used metallic powders such as of aluminum, oxides such as zinc white and titanium oxide, and inorganic salts such as calcium carbonate, magnesium carbonate, and potassium phosphate so long as they are either sparingly soluble or insoluble in water as well as in th monomers being used. The particle diameters should be lower than several microns, more desirably below submicrons. As the polymerization initiators, there may be used any chemicals which are usually employed for the reaction of polymerization. Generally, there are used BPO (benzoyl peroxide) and AIBW (azo-bisisobutylonitrile). Besides these, there may be incorporated such chain transfer agents as lauryl mercaptan, various plasticizers, modifying polymers, prepolymers, and oligomers, dyes, and electric charging series modifiers. As the fluidizers, there are used resinous substances of varying kinds having SP values in the range of from 7.8 to 16.1. For example, there may be used ethylcellulose resin (SP of about 11.4), polyurethane resin (SP of about 10.0), amino resin (SP of about 10.7), epoxy resin (SP of about 13.0), and alkyl resin (SP of about 8.6). For practical use, the molecular weights thereof may range from fairly low level to high level, namely, from the so-called oligomers to polymers of varying kinds.

In the following are cited some working embodiments of the present invention:

EXAMPLE 1

A mixture of the following composition was blended by using an attriter. (In parts by weight)

| Run No. | (1) | (2) |
|---|---|---|
| Monomer (60/40 styrene:ethyl acrylate) | 100 | 100 |
| Coloring material (cyanin black 2BX, Sumitomo) | 8 | 8 |
| Polymerization initiator (azo-bisisobutylonitrile | 4 | 4 |
| Dispersion stabilizer (magnesium carbonate) | 100 | 100 |
| Fluidizer (Uban 32 of Toyo Koatsu) | — | 0.25 |

The effluent from Run No. (1) had insufficient fluidity and was difficult to remove and magnesium carbonate used as the dispersion stabilizer was readily separable from the monomers. In contrast, the effluent from Run No. (2) had sufficient fluidity and magnesium carbonate was dispersed sufficiently and did not form any grain and, consequently, the fluid was stable. Each of the effluents was added with agitation into 400 parts of water in a polymerization agitator and allowed to polymerize at 90°C for 5 hours and thereafter cooled. Subsequently, 550 parts by weight of hydrochloric acid was added thereto to dissolve magnesium carbonate. The mix was washed with water in a centrifugal separator, dehydrated, and dried by means of a flash drier to obtain a black toner. The removing condition from the ball mill and the particle diameter of the resultant polymer particles were as shown in the table below.

| Test No. | Removing condition from ball mill | | | Particle diameter of polymer particles | |
|---|---|---|---|---|---|
| | Fluidity | Viscosity CP | Grind gauge (grain) Mil | Average μ | Distribution μ |
| (1) | Inferior | >50000 | 4.0 | 95 | 5 – 170 |
| (2) | Good | 380 | 0 | 16 | 2 – 30 |

By incorporating 0.25% of Uvan 32 varnish, an amino resin made by Toyo Koatsu, as the fluidizer, a remarkable improvement was achieved in the fluidity of the polymer fluid and the stability of the dispersion of the finely divided stabilizer. Consequently, the polymer particles were pulverized much more finely and to an extremely uniform particle size. When the product was used as the electrophotographic toner, there was obtained a satisfactory image. The value of ultimate viscosity of Uvan 32 in various solvents was 0.059 in acetone having SP 9.9, 0.078 in pyridine having SP 10.7, 0.076 in n-butanol having SP 11.4, and 0.060 in ethanol having SP 12.7. Therefore the SP value was determined as 10.7.

EXAMPLE 2

A mixture of the following composition was blended by using a ball mill.

| Test No. | (3) | (4) | (5) | (6) | (7) | (8) |
|---|---|---|---|---|---|---|
| Monomer (70/30 styrene: n-butyl methacrylate) | 100 | 100 | 100 | 100 | 100 | 100 |
| Coloring material (carbon black No.35 of Asahi Carbon) | 10 | 10 | 10 | 10 | 10 | 10 |
| Polymerization initiator (azo-bisisobutylonitrile) | 4 | 4 | 4 | 4 | 4 | 4 |
| Dispersion stabilizer (zinc white, Super grade, of Sakai Chemical) | 25 | 50 | 100 | 25 | 50 | 100 |
| Fluidizer (ethylcellulose-N-10 of Hercules) | — | — | — | 0.02 | 0.10 | 0.50 |

The blends from Run No. (3), (4), and (5) all had insufficient fluidity, and this trend became more conspicuous with the increasing amount of zinc white, Super grade, used as the dispersion stabilizer. The blend from Run No. (5) was substantially impossible to remove from the ball mill. In contrast, the blends which had incorporated ethylcellulose N-10 as the fluidizer were quite satisfactory in fluidity, dispersion stability of zinc white, and dispersion stability of carbon black No. 35 added as the coloring material. These blends were polymerized, treated with acids, washed with water, and dried by the same procedure as in Example 1, to afford black toners. The removing condition from ball mill and the particle diameter of polymer particles were as shown below.

| Test No. | Removing condition from ball mill | | | Particle diameter of polymer particles | |
|---|---|---|---|---|---|
| | Fluidity | Viscosity Cp | Grind gauge Mil | Average μ | Distribution μ |
| (3) | Slightly Inferior | 27000 | 3.5 | 55 | 5 – 90 |
| (4) | Inferior | >50000 | 4.0 | 25 | 3 – 50 |
| (5) | Extremely Inferior | >50000 | >4.0 | 70 | 10 – 185 |
| (6) | Satisfactory | 460 | 0 | 15 | 3 – 27 |
| (7) | Satisfactory | 590 | 0 | 9.8 | 2 – 20 |
| (8) | Satisfactory | 1900 | 0 | 5.5 | 1 – 13 |

Thus, the effect of the fluidizer, ethyl cellulose N-10 (hercules), was quite conspicuous. Only by using this fluidizer, it was possible to obtain uniform polymer particles having an average particle diameter of several microns and having particle distribution in a very narrow range. The toners from Run No. (3), (4), and (5) had coarse particles for the reproduction of ordinary documents and showed inferior electrophotographic properties. By comparison, the toners from Run No. (6), (7), and (8) which used the fluidizer produced quite satisfactory image quality. The fixing property was also extremely good.

The particle size distribution of polymer particles was determined more closely by using a particle size distribution measuring device (KORUTAA counter), and the results were compared with those obtained for the toners prepared by the pulverization method. The results are shown below. As is clear from the data, the suspension polymerization toner of the method of this invention was composed of extremely uniform particles having a narrower distribution and containing finer particles and coarser particles in a far smaller amount than the toner of the pulverization process of the same average particle diameter.

| Method | Run No. | Average particle diameter | Cumulative percentage | | | | |
|---|---|---|---|---|---|---|---|
| | | μ | 2 | 4 | 6 | 8 | 10 |
| Pulverization | | 14.8 | 0.3 | 1.3 | 4.2 | 10.6 | 19.6 |
| This invention | (6) | 15.0 | | 0.1 | 0.8 | 1.7 | 10.6 |
| | (7) | 9.8 | 0.1 | 0.6 | 5.0 | 15.6 | 51.5 |
| | (8) | 5.5 | 15.9 | 59.6 | 90.3 | 97.5 | 99.8 |

| Method | Run No. | Average particle diameter | Cumulative percentage | | | | |
|---|---|---|---|---|---|---|---|
| | | μ | 15 | 20 | 25 | 30 | 40μ |
| Pulverization | | 14.8 | 52.1 | 79.5 | 91.0 | 96.8 | 99.7 |
| This invention | (6) | 15.0 | 50.0 | 91.7 | 98.2 | 99.8 | |
| | (7) | 9.8 | 93.7 | 99.6 | 99.9 | | |
| | (8) | 5.5 | | | | | |

In the following solvents, ethyl cellulose N-10 showed the ultimate viscosities (at 25°C) as follows.

| Name of solvent | SP | Ultimate viscosity (n) |
|---|---|---|
| n-Butyl acetate | 8.5 | 0.815 |
| Aylol | 8.8 | 0.820 |
| Methylethyl ketone | 9.3 | 0.825 |
| Methylene chloride | 9.7 | 0.822 |
| Acetone | 9.9 | 0.827 |
| Ethyleneglycol monoethyl ether | 10.5 | 0.833 |
| Pyridine | 10.7 | 0.837 |
| Nitroethane | 11.1 | 0.830 |
| n-Butanol | 11.4 | 0.848 |
| Acetonitrile | 11.9 | 0.838 |
| N,N-dimethylformamide | 12.1 | 0.840 |
| Ethanol | 12.7 | 0.802 |
| Nitromethane | 12.7 | 0.800 |
| Propiolactone | 13.3 | 0.801 |
| Methanol | 14.5 | 0.796 |

Therefore, the SP value of ethyl cellulose N-10 is 11.4.

EXAMPLE 3

A mixture of the following composition was blended.

| | | |
|---|---|---|
| 50/50 acrylic acid: methyl methacrylate | 100 | parts |
| Lake red D (Toyo Ink) | 10 | |
| Benzoly peroxide | 3 | |
| Potassium phosphate | 50 | |
| Nissan SS sealer varnish solid | 0.03 | |

The mix was similarly suspension polymerized in water by using a polymerization agitator. Consequently, there was obtained a red electrophotographic toner having the average particle diameter of 12 microns and the particle distribution in the range of from 3 to 25 μ. Incorporation of the fluidizer, shellac resin Nissan SS sealer (Nippon Yushi), imparted good fluidity in the polymer fluid removed from the ball mill. The SP value of this fluidizer was found to be 16.1.

EXAMPLE 4

A mixture of the following composition was prepared.

| | | |
|---|---|---|
| 50/50 vinyl acetate: ethyl methacrylate | 100 | parts |
| Benzoyl peroxide | 5 | |
| Barium sulfate | 35 | |
| Fluidizer | 0.08 | |

As the fluidizer, there were used polyurethane resin ORESTAA F78-50X varnish (Toyo Koatsu) and phenyl resin TERABINAITO No. 1000 varnish (Chugoku Paint) each in the amount of 0.08 part by weight as the solid. Each of the two mixes was suspension polymerized in 400 parts by weight of water incorporating therein 5% of MIKETON fast yellow G (Mitsu Chemical), a dispersible dye. Consequently, there were obtained satisfactory electrophotographic toners yellow in color and having the average particle diameter of 13.5 μ and 15 μ. The SP value of ORESTAA F78-50X was 10.0, while that of TERABINAITO No. 1000 was 14.5.

EXAMPLE 5

A mixture of the following composition was prepared.

| | | |
|---|---|---|
| Styrene | 100 | parts |
| Oil Blue-IIN (Orient Chemical) | 15 | |
| Azobisisobutylonitrile | 4 | |
| Calcium carbonate | 40 | |
| ANBERORU F-7 (Rohm & Haas) | 20 | |

The mix was suspension polymerized in water. Consequently there was obtained a blue electrophotographic toner having an average particle diameter of 10 microns. The product could be removed from the ball mill quite satisfactorily and showed excellent stability of the dispersion of both pigments and calcium carbonate used as the sparingly soluble finely divided dispersion stabilizer. ANPERORU F-7 used as the fluidizer was a rosin-modified resin and showed an SP value of 7.8. When polydimethyl siloxane having SP value of 7.3 was used as the fluidizer, the fluidizability was insufficient and could not fulfill the purpose of the present invention.

Several working embodiments of the present invention have been described. The scope in which the present invention can be applied is not limited to these examples. It embraces a far greater scope of contents as has been described. With a view to promoting the dispersion and stabilization of the finely divided dispersion stabilizer in the polymer liquid without using the surface active agent which tends to exert adverse effects on the polymerization process and on the product quality and consequently obtaining uniform polymer particles having particle sizes in a narrow range and capable of being used as electrophotographic toner, this invention is characterized by incorporating, as the fluidizer of the polymer fluid, a relatively polar resinous substance having SP (solubility parameter value) value in the range of from 7.8 to 16.1. By this method, it is possible to obtain polymer particles having average particle diameters in the range of from 0.1 to 100 $\mu$ suitable for use as electrophotographic developer. Where application to the reproduction of ordinary documents alone is taken into consideration, the average particle diameter of the developer is desired to be below 25 $\mu$.

What is claimed is:

1. In a manufacturing method for producing an electrophotographic developer comprising polymer particles by suspension polymerizing, in an aqueous phase, a polymerization liquid comprising at least one polymerizable vinyltype monomer selected from the group consisting of styrene, acrylic alkyl, methacrylic alkyl, vinyl chloride and vinyl acetate, a polymerization initiator, and a finely divided dispersion stabilizer either sparingly soluble or insoluble in water and said monomer, said polymerization liquid being blended prior to said suspension polymerization, the improvement comprising adding to said polymerization liquid a resinous substance, as a fluidizer, soluble in the synthetic resin monomer and having a solubility parameter in the range of from 7.8 to 16.1, the addition ratio of said resinous substance to said vinyltype monomer being approximately 0.001% to 1%, said dispersion stabilizer being uniformly dispersed throughout said polymerization liquid during said blending, next suspending the blended polymerization liquid containing the fluidizer in said aqueous phase, and then subjecting the blend to said suspension polymerization whereby the formation of said polymer particles having average particle diameters in the range of from 0.1 to 100 $\mu$ is effected during said suspension polymerization.

2. In a manufacturing method for an electrophotographic developer as claimed in claim 1, wherein said polymerization initiator is benzoyl peroxide or azobisisobutylonitrile.

3. A manufacturing method for an electrophotographic developer as claimed in claim 1, wherein the finely divided dispersion stabilizer is selected from the group consisting of metallic powders, inorganic oxides, and inorganic salts so long as these are either sparingly soluble or insoluble in water as well as in the monomer being used.

4. A manufacturing method for an electrophotographic developer as claimed in claim 3, wherein said finely divided dispersion stabilizer is said metallic powder and it is aluminum.

5. A manufacturing method for an electrophotographic developer as claimed in claim 3, wherein said finely divided dispersion stabilizer is said inorganic oxide and it is selected from the group consisting of zinc white and titanium oxide.

6. A manufacturing method for an electrophotographic developer as claimed in claim 3, wherein said finely divided dispersion stabilizer is said inorganic salt and it is selected from the group consisting of calcium carbonate, magnesium carbonate, potassium phosphate, calcium phosphate and barium sulfate.

7. In a manufacturing method for an electrophotographic developer as claimed in claim 1, wherein said resinous substance is ethylcellulose resin, polyurethane resin, amino resin, epoxy resin, phenol resin or alkyd resin.

8. In a manufacturing method as in claim 1 where the range of said polymer particles is from 0.1 to 25 microns in average particle diameter thereof.

9. In a manufacturing method for an electrophotographic developer as claimed in claim 1, wherein coloring materials are incorporated in said polymerization liquid.

* * * * *